United States Patent [19]

Walkhoff et al.

[11] Patent Number: 4,793,077

[45] Date of Patent: Dec. 27, 1988

[54] ARTICLE OF ATHLETIC FOOTWEAR, ESPECIALLY A SKI BOOT

[75] Inventors: Klaus Walkhoff, Kreuzlingen, Switzerland; Erik O. Giese, Snowmass Village, Colo.

[73] Assignee: Raichle Sportschuh AG, Kreuzlingen, Switzerland

[21] Appl. No.: 942,898

[22] Filed: Dec. 17, 1986

[30] Foreign Application Priority Data

Dec. 23, 1985 [CH] Switzerland ..... 05512/85

[51] Int. Cl.[4] ..... A43B 5/04

[52] U.S. Cl. ..... 36/117; 36/45; 36/120

[58] Field of Search ..... 36/117–121, 36/50, 54, 105, 114, 45

[56] References Cited

U.S. PATENT DOCUMENTS

| | | | |
|---|---|---|---|
| 3,775,866 | 12/1973 | Marker | 36/117 |
| 3,988,842 | 11/1976 | Rathmell | 36/121 |
| 4,281,468 | 8/1981 | Giese et al. | 36/121 |
| 4,562,652 | 1/1986 | Hensler | 36/45 X |
| 4,658,517 | 4/1987 | Miyoshi et al. | 36/117 |
| 4,677,769 | 7/1987 | Ahmad et al. | 36/117 |

FOREIGN PATENT DOCUMENTS

| | | | |
|---|---|---|---|
| 374094 | 3/1984 | Austria . | |
| 0167765 | 1/1986 | European Pat. Off. | 36/117 |
| 2409907 | 10/1974 | Fed. Rep. of Germany | 36/117 |
| 2925554 | 1/1981 | Fed. Rep. of Germany | 36/117 |
| 3336063 | 4/1984 | Fed. Rep. of Germany . | |
| 2292442 | 6/1976 | France . | |
| 49-112743 | 10/1974 | Japan . | |
| 59-103604 | 7/1984 | Japan . | |
| 481592 | 1/1970 | Switzerland . | |

*Primary Examiner*—James Kee Chi

*Attorney, Agent, or Firm*—Werner W. Kleeman

[57] ABSTRACT

A shoe upper portion of a ski boot comprises a shell portion enclosing the foot and a tongue portion attached thereto. The tongue portion comprises an instep region and a shin region and a transition region therebetween. A corrugated or undulated wall section having elevations and depressions, i.e. corrugations, is located in the transition region. This wall section is composed of a different type of material than the remainder of the tongue portion and possesses a lower bending stiffness or flexural rigidity than the remainder of the tongue portion. This wall section is non-detachably joined to the remainder of the tongue portion and forms therewith a unitary structure. The larger bending or flexural elasticity of the wall section facilitates bending of the lower leg.

24 Claims, 13 Drawing Sheets

ARTICLE OF ATHLETIC FOOTWEAR, ESPECIALLY A SKI BOOT

BACKGROUND OF THE INVENTION

The present invention broadly relates to an article of athletic footwear and, more specifically, pertains to a new and improved construction of a ski boot.

Generally speaking, the article of athletic footwear of the present invention comprises a shoe upper portion with regions having different bending characteristics.

Synthetic or plastic ski boots possess a relatively stiff or rigid shoe upper portion which greatly impedes or hinders walking therewith as well as bending of the lower leg in a forward and also in a rearward direction. Several proposals for the elimination of these disadvantages have therefore already been made. In this respect ski boots are known which have corrugations or undulations or wavy portions in the shin-instep region such as disclosed, for instance, in U.S. Pat. No. 3,988,842 and International patent publication WO 81/00,507. However, although this feature facilitates bending of the lower leg in the forward direction, such can not be considered as having sufficiently overcome the above-mentioned disadvantages to the required extent. Furthermore, it should be noted that lower temperatures cause a decrease of the bending or flexural elasticity also of or wavy the corrugated regions of the shoe upper portion.

European Patent Publication No. 0,053,340 has further proposed ski boots in which material possessing rubber-like elastic properties is inserted into slits in the instep-shin region of the shoe upper portion. Although these inserts, which upon bending of the lower leg are not elastically deflected but instead are compressed, and also cause the forward movement of the shoe upper portion to be dampened and the resilience properties or characteristics of the shoe upper portion to be improved, nonetheless a considerable expenditure with respect to fabrication is necessary.

SUMMARY OF THE INVENTION

Therefore, with the foregoing in mind it is a primary object of the present invention to provide a new and improved construction of an article of athletic footwear, especially a ski boot, which does not exhibit the aforementioned drawbacks an shortcomings of the prior art constructions.

Another and more specific object of the present invention aims at providing a new and improved construction of an article of athletic footwear he previously mentioned type and having a bending behavior or characteristic which can be selected between wider limits without requiring substantial additional expenditure with respect to fabrication.

Yet a further significant object of the present invention aims at providing a new and improved construction of a ski boot of the character described which is relatively simple in construction and design, extremely economical to manufacture, highly reliable in use, and affords greater comfort during walking.

Now in order to implement these and still further objects of the present invention which will become more readily apparent as the description proceeds, the ski boot of the present invention is manifested by the features that, at least a wall section of the shoe upper portion, which wall section is subjected to bending loads, possesses a lesser or lower bending or flexural rigidity than the surrounding wall region. This wall section is made of a different type of material than the material of the surrounding wall region and is non-detachably joined or attached to such surrounding wall region.

By providing the wall section having a lesser or lower bending or flexural rigidity than the surrounding wall region and because the wall sections are made of a different material than the surrounding wall region, an increased bending or flexural elasticity or flexibility can be achieved at the desired locations of the shoe upper portion. The configuration and location of these more flexible or bending-elastic or more flexurally-elastic wall sections can be freely chosen to a large extent and also, a certain freedom exists in the choice of material for these wall sections. Consequently, the bending behavior or characteristic of the shoe upper portion can be better adapted to different requirements than has heretofore been possible in prior art ski boots.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
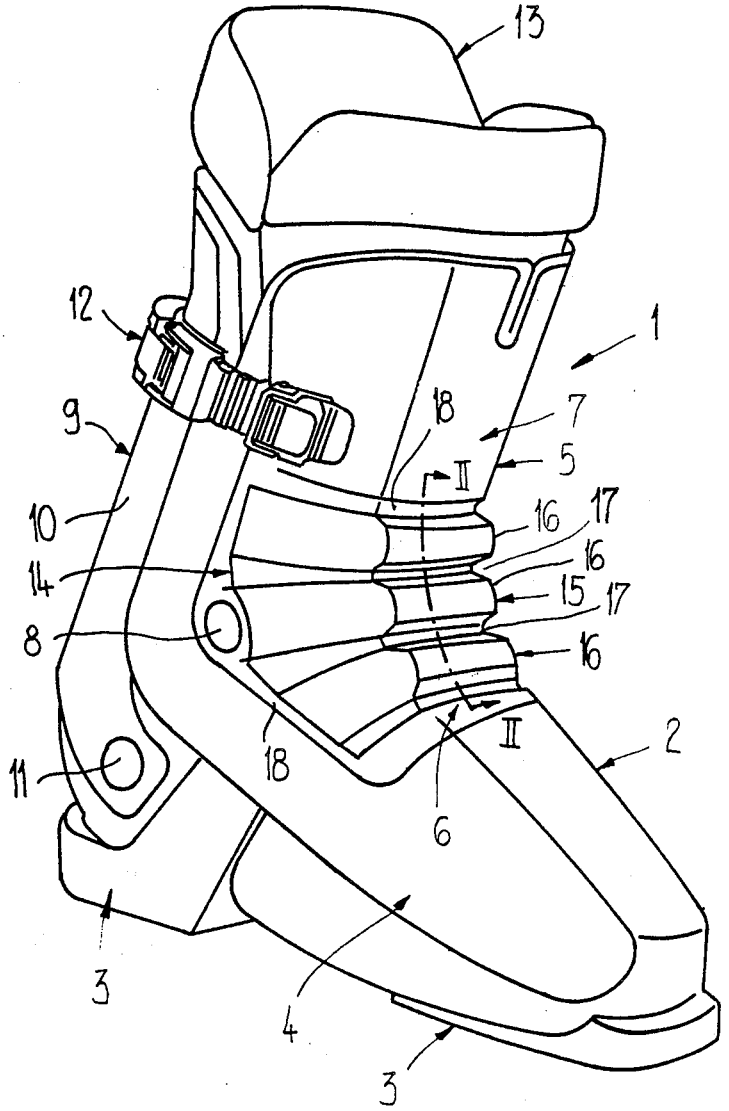
FIG. 1 shows a perspective view of first exemplary embodiment of the ski boot according to the invention containing a ribbed or corrugated wall section incorporated into a tongue portion of the ski boot and possessing a greater bending or flexural elasticity or flexibility.

Describing now the drawings, it is to be understood that to simplify the showing thereof only enough of the structure of the ski boot has been illustrated therein as is needed to enable one skilled in the art to readily understand the underlying principles and concepts of the present invention. Turning now specifically to FIG. 1 of the drawings, the embodiment of ski boot 1 illustrated therein by way of example and not limitation will be seen to comprise a shoe upper portion 2 and a sole portion 3, both made of plastic or any another suitable synthetic material. The shoe upper portion 2 comprises a relatively stiff or rigid shell portion 4 enclosing or surrounding the foot and a tongue portion 5 extending over or overlapping the shell portion 4. The tongue portion 5 extends into an instep region 6 and a shin region 7. This tongue portion 5 is joined to the shell portion 4 at connecting locations indicated by reference numeral 8 on either side thereof.

The shoe upper portion 2 further comprises a rear shaft portion or spoiler portion 10 which is arranged in a calf region 9 and which is pivotly attached to the shell portion 4 by means of hinges or pivot joints 11 arranged on either side thereof. The rear shaft or spoiler portion 10 is releasably connected to the tongue portion 5 by means of a closure assembly 12 of known type.

A soft cushioned inner lining or inner shoe 13 is arranged in the interior of the shoe upper portion 2 in a manner which is known as such. Not illustrated in FIG. 1, is a foot restraining plate which is arranged between the inner lining or inner shoe 13 and the shoe upper portion 2. This foot restraining plate can be applied to the foot by means of a tensioning lever which is likewise not visible in FIG. 1 and which is arranged at the rear shaft or spoiler portion 10, in the manner as described in greater detail in European Patent Publication No. 0,157,240.

Figure 2:
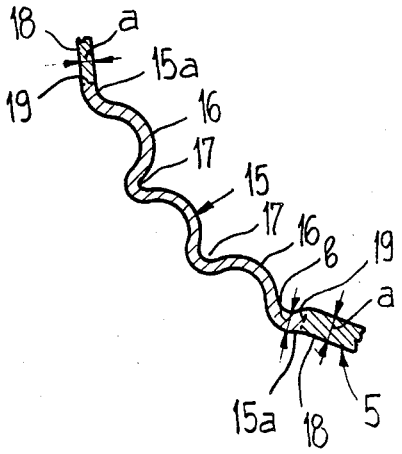
FIG. 2 shows a section taken along the line II—II in FIG. 1.

In a transition region 14 extending from the instep region 6 to the shin region 7, the tongue portion 5 is provided with an undulated or corrugated wall section 15, see also FIG. 2. This wall section 15 contains elevations rridges 16 and depressions or hollows 17 located therebetween.

This wall section 15 is made of a different type of material than the material of the remaining part or remainder of the tongue portion 5, the shell portion 4 and the rear shaft or spoiler portion 10 such that this wall section 15 possesses a lower bending stiffness or bending or flexural rigidity and consequently a greater bending or flexural elasticity or flexibility than the remaining part of the tongue portion 5, the shell portion 4 and the rear shaft or spoiler portion 10. The tongue portion 5, the shell portion 4 and the rear shaft or spoiler portion 10 is made, by way of example, of the same polyamide whereas the wall section 15 is made of a different polyamide. Therefore, the tongue portion 5, the shell portion 4 and the rear shaft or spoiler portion 10, on the one hand, and the wall section 15, on the other hand, are made of plastic or synthetic material of the same chemical category but of different characteristics or properties. The material sold under the designation "Grilamid" has proved to be suitable for all these parts, by way of example.

As shown in FIG. 2, the wall thickness b of the wall section 15, at least in the marginal or border region 15*a* thereof, is about as large as the wall thickness a of a wall region 18 of the tongue portion 5 and which wall region 18 surrounds this marginal or border region 15*a* of the wall section 15.

Fabrication of all parts 4, 5, 10 of the shoe upper portion 2 preferably is performed by injection molding. It has proved expedient to produce the wall section 15 in a separate operational step and to subsequently insert the finished wall section 15 into the injection mold for the tongue portion 5. During the following introduction of the material for the tongue portion 5, the inserted wall section 15 softens, at least in its marginal or border region 15*a*, resulting in a fusion of the marginal or border region 15*a* of the wall section 15 with the surrounding wall region 18 of the tongue portion 5 along a joining or connection zone 19 indicated by broken lines in FIG. 2. In this manner the wall section 15 is firmly and undetachably joined or attached to the neighboring and surrounding wall region 18 of the tongue portion 5 to thus form a virtually integral or unitary structure.

Figure 3:
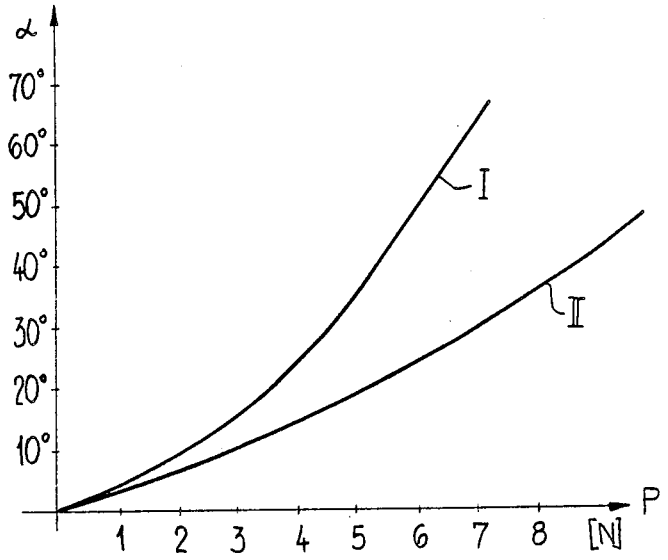
FIG. 3 shows a diagram explaining the different bending behaviors or characteristics, especially the interrelationship between bending angle and bending force, of different shoe upper portions made of different types of materials.

It will be appreciated that, as a result of the wall section 15 having lesser bending or flexural rigidity than the remainder of the tongue portion 5, a bending behavior or characteristic is beneficially achieved which is different from that obtained if the entire tongue portion 5 would consist of the material throughout. This will be explained with reference to FIG. 3 which shows a bending deflection or bending angle $\alpha$ of plastic parts as a function of a bending force P applied thereto. Curve I relates to a component made of a plastic material having a greater bending or flexural elasticity or flexibility and of the type as used for the wall section 15. Curve II relates to a component made of a plastic material having a lesser bending or flexural elasticity or flexibility, in other words, a greater bending or flexural rigidity and of the type as used for the remainder of the tongue portion 5. It will be apparent that, under the action of the same predetermined bending force P, the component made of the material which possesses the greater bending or flexural elasticity or flexibility, experiences the greater bending angle $\alpha$.

Figure 4:
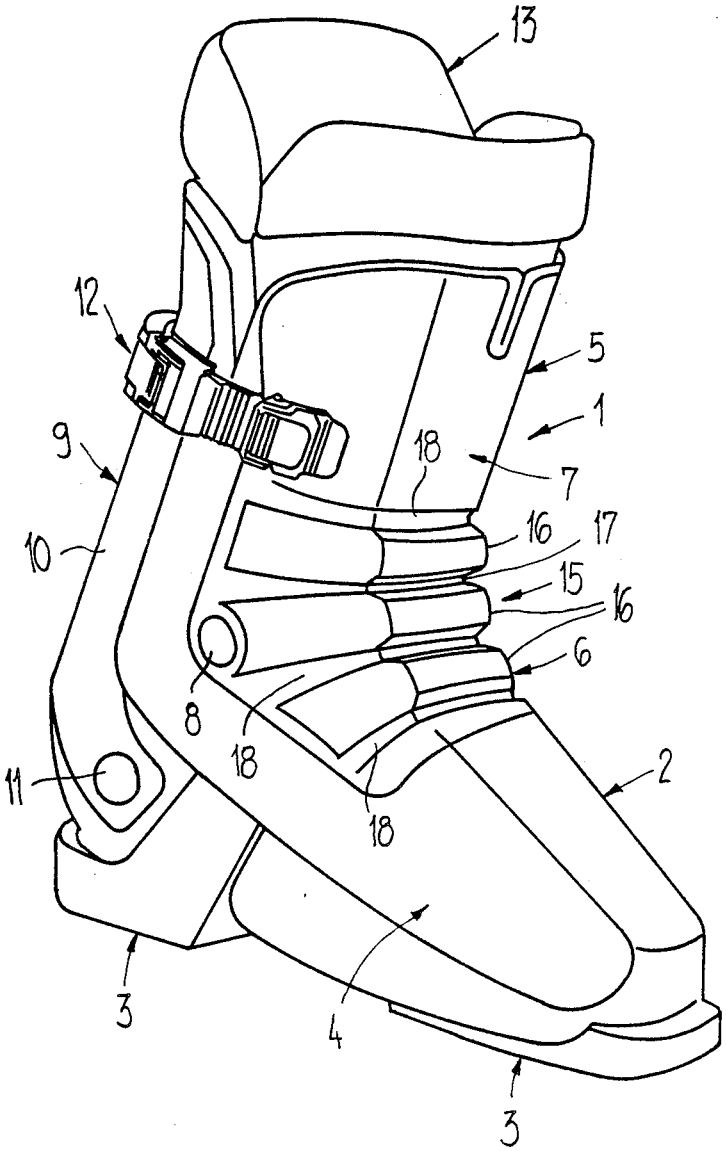
FIG. 4 shows a perspective view of a second exemplary embodiment of the inventive ski boot wherein only the elevations of the corrugated wall section possess a greater bending or flexural elasticity or flexibility.
Figure 5:
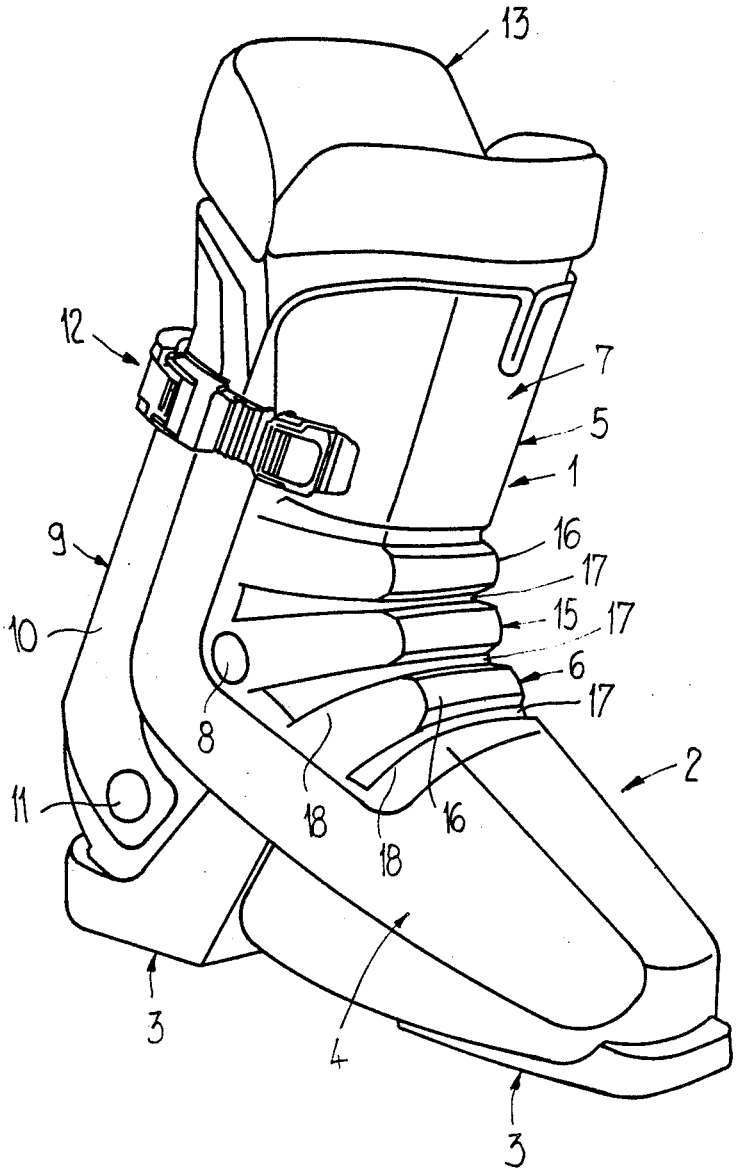
FIG. 5 shows a perspective view of a third exemplary embodiment of the inventive ski boot wherein only the depressions of the corrugated wall section possess a greater bending or flexural elasticity or flexibility.
Figure 6:
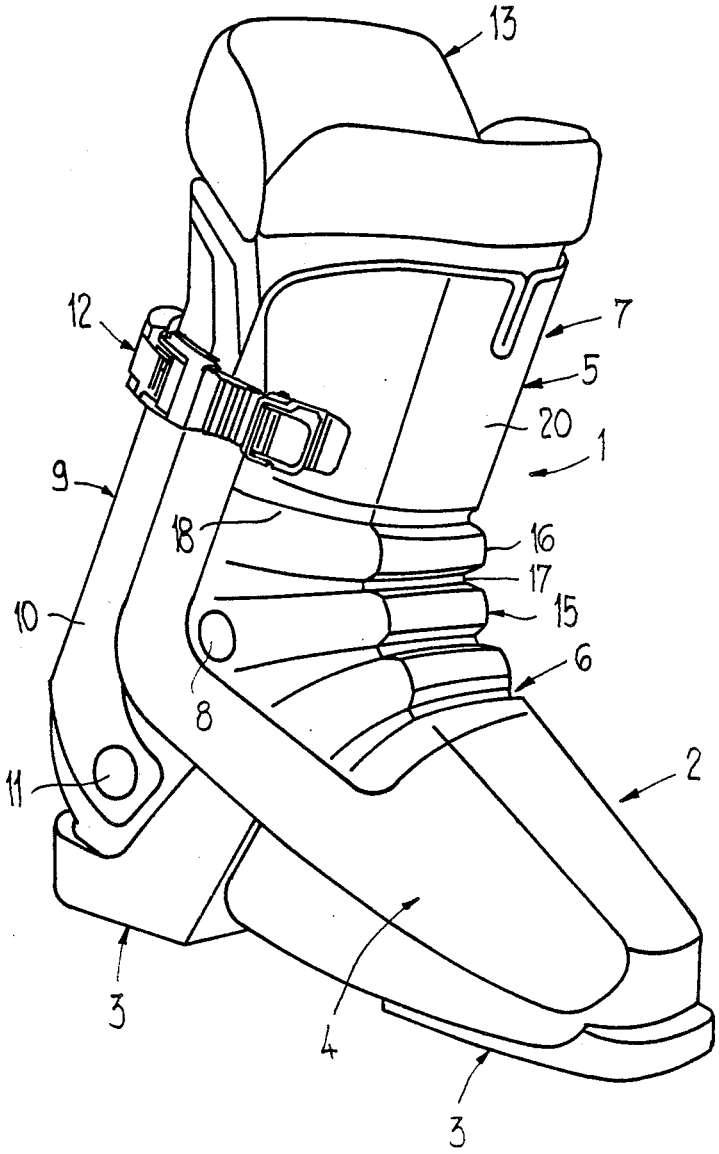
FIG. 6 shows a perspective view of fourth exemplary embodiment of the inventive ski boot wherein a topmost wall section of the tongue portion possesses a greater bending or flexural elasticity or flexibility.

The second, third and fourth exemplary embodiments of the inventive ski boots respectively illustrated in FIGS. 4, 5 and 6, substantially correspond to the first embodiment of such ski boot shown in FIG. 1 but differ therefrom as well as from each other by different arrangements or constructions of the wall section 15 having the greater bending or flexural elasticity or flexibility.

The second and third embodiments of the inventive ski boot respectively shown in FIGS. 4 and 5, differ from the ski boot shown in FIG. 1 in that not the entire corrugated wall section 15 consists of a more bending-elastic or flexible material but only the elevations or ridges 16, see FIG. 4, or only the depressions or hollows 17, see FIG. 5. In the third embodiment shown in FIG. 6, the topmost wall section 20 of the tongue portion 5, which topmost wall section 20 is arranged in the shin region 7, consists of the more bending-elastic or flexible material and not the corrugated or undulated wall section 15.

The fifth to ninth exemplary embodiments of the inventive ski boot respectively shown in FIGS. 7, 8, 9, 10 and 11, depict ski boots which are similar to each other and differ from one another only by different arrangements or constructions of the more bending-elastic or flexible wall sections. Compared with the ski boots according to FIGS. 1, 4, 5 and 6, the ski boots according to FIGS. 7 to 11 differ in that there is no tongue portion 5 present which is separate from the shell portion 4, but the shell portion 4 extends over the instep region 6 into the shin region 7. The shoe upper portion 2 of the ski boots according to FIGS. 7 to 11 thus only comprises two parts, namely the integral shell portion 4 provided with the sole portion 3 and the rear shaft or spoiler portion 10. . In FIGS. 7 to 11, there is shown the aforementioned tensioning lever 21 for tensioning and loosening the foot restraining plate. In the area of the transition region 14 from the instep region 6 to the shin region 7, the shell portion 4 contains an undulated or corrugated region 22.

Figure 7:
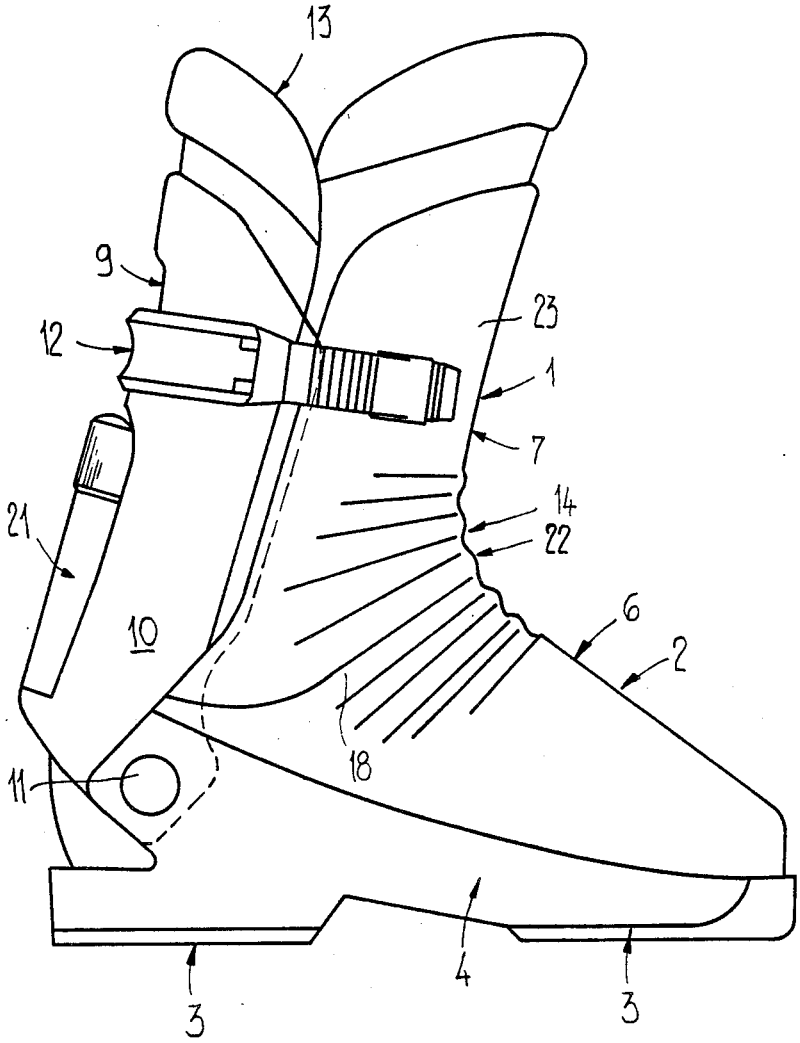
FIG. 7 shows a side view of a fifth exemplary embodiment of the inventive ski boot containing a more bending-elastic or flexible wall section.

In the fifth embodiment shown in FIG. 7, an upper wall section 23 located in the shin region 7, is made of a different type of material than the remainder of the shell portion 4 and is more bending-elastic or flexible in comparison thereto, i.e. possesses greater bending or flexural elasticity or flexibility.

Figure 8:
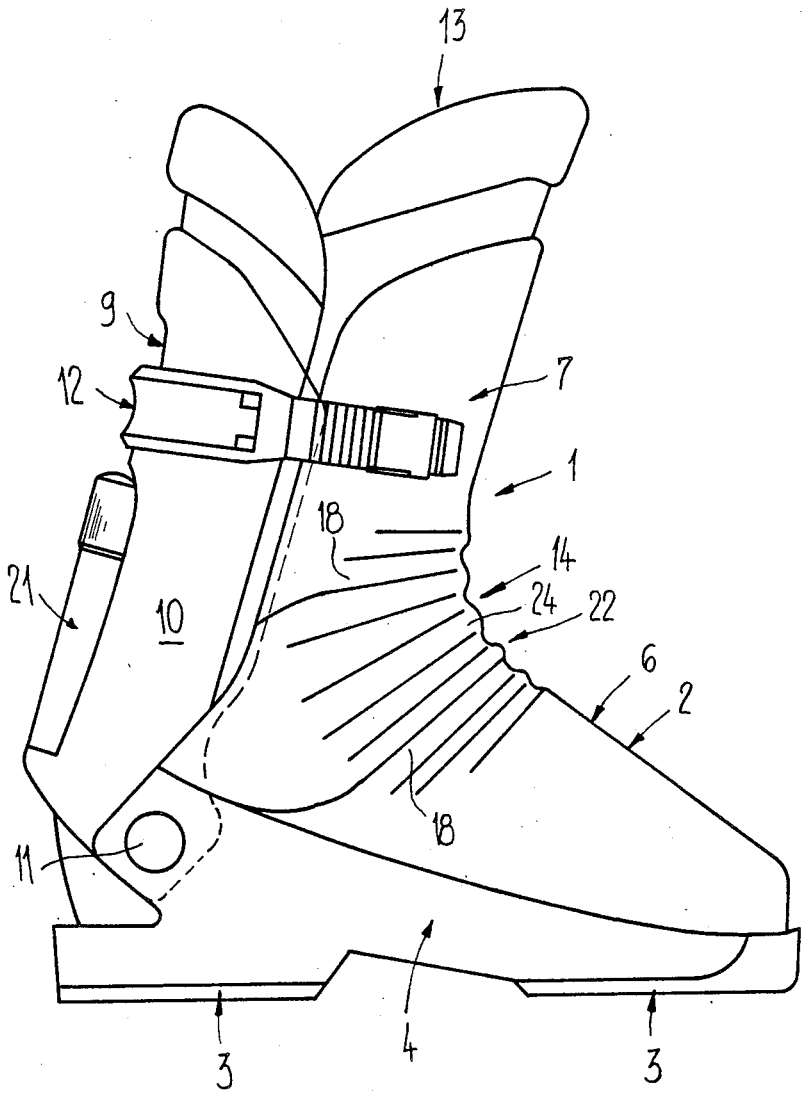
FIG. 8 shows a side view similar to FIG. 7 of a sixth exemplary embodiment of the inventive ski boot.

In the sixth embodiment of the ski boot shown in FIG. 8, a wall section of the shell portion 4 is designated by reference numeral 24 and has less bending rigidity, i.e. greater bending-elasticity or flexibility than the remainder of the shell portion 4. This wall section 24 of greater bending or flexural elasticity or flexibility is located in the area of the transition region 14 from the instep region 6 to the shin region 7.

Figure 9:
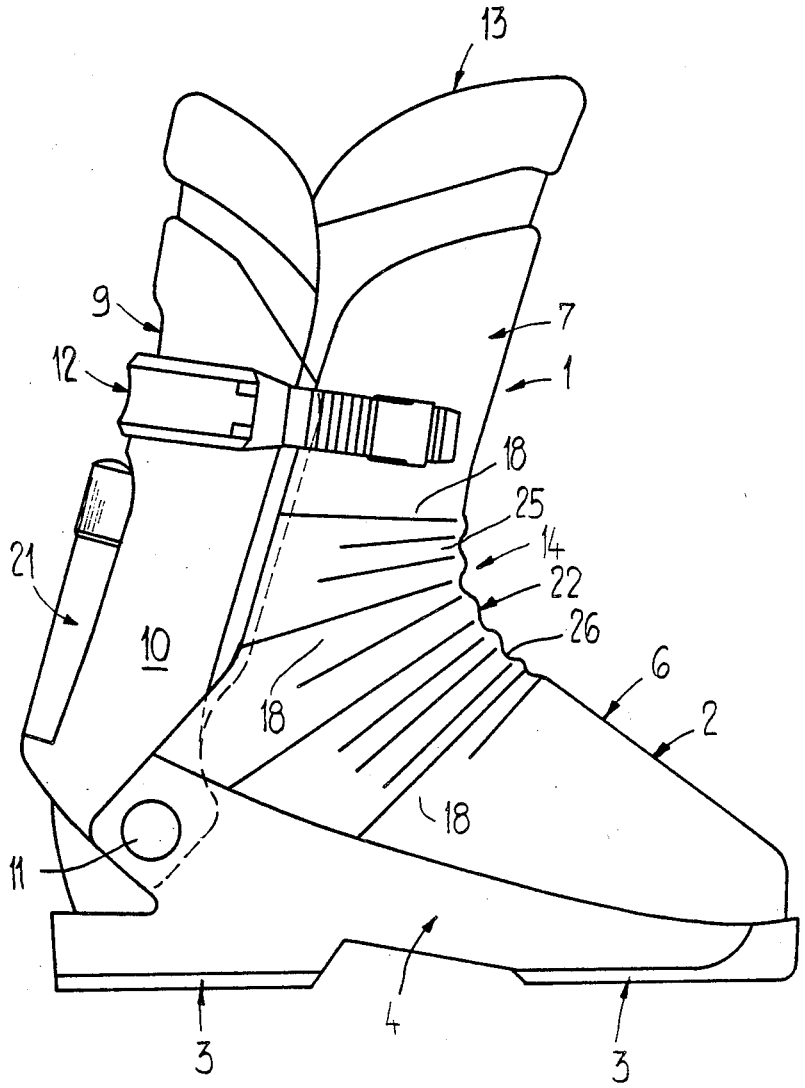
FIG. 9 shows a side view similar to FIG. 7 of a seventh exemplary embodiment of the inventive ski boot.
Figure 10:
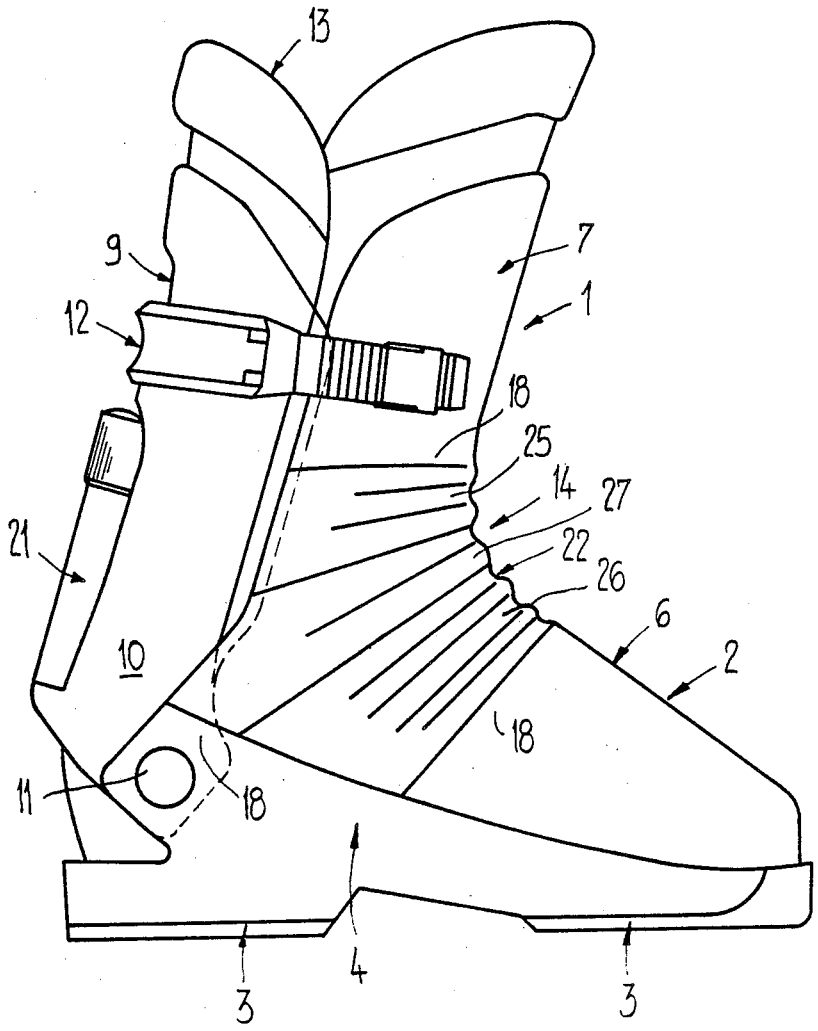
FIG. 10 shows a side view similar to FIG. 7 of an eighth exemplary embodiment of the inventive ski boot.

The shell portion 4 of the seventh ski boot embodiment depicted in FIG. 9 has two wall sections 25 and 26 possessing a greater bending or flexural elasticity or flexibility. The wall sections 25 and 26 are respectively located in the shin region 6 and the instep region 7 or in the transition region 14 between these skin and instep regions 6 and 7. The region located between these wall sections 25 and 26 either can be made of the same material having the same bending or flexural rigidity as the remainder of the shell portion 4 or may be constructed such as to differ with respect to its bending or flexural elasticity or flexibility from the wall sections 25 and 26 as well as from the remainder of the shell portion 4, see FIG. 10. In this particular embodiment, the wall section marked 27 is made of a material having properties which differ from those of the plastic material used for the wall sections 25 and 26 as well as from those of the plastic material used for the remainder of the shell portion 4. In this manner, there are thus obtained two different regions or areas, namely the wall sections 25 and 26, on the one hand, and the wall section 27, on the other hand, which regions or areas have lower bending rigidity, i.e. greater bending or flexural elasticity or flexibility but also differ between themselves with respect to their bending-elastic or flexible properties.

Figure 11:
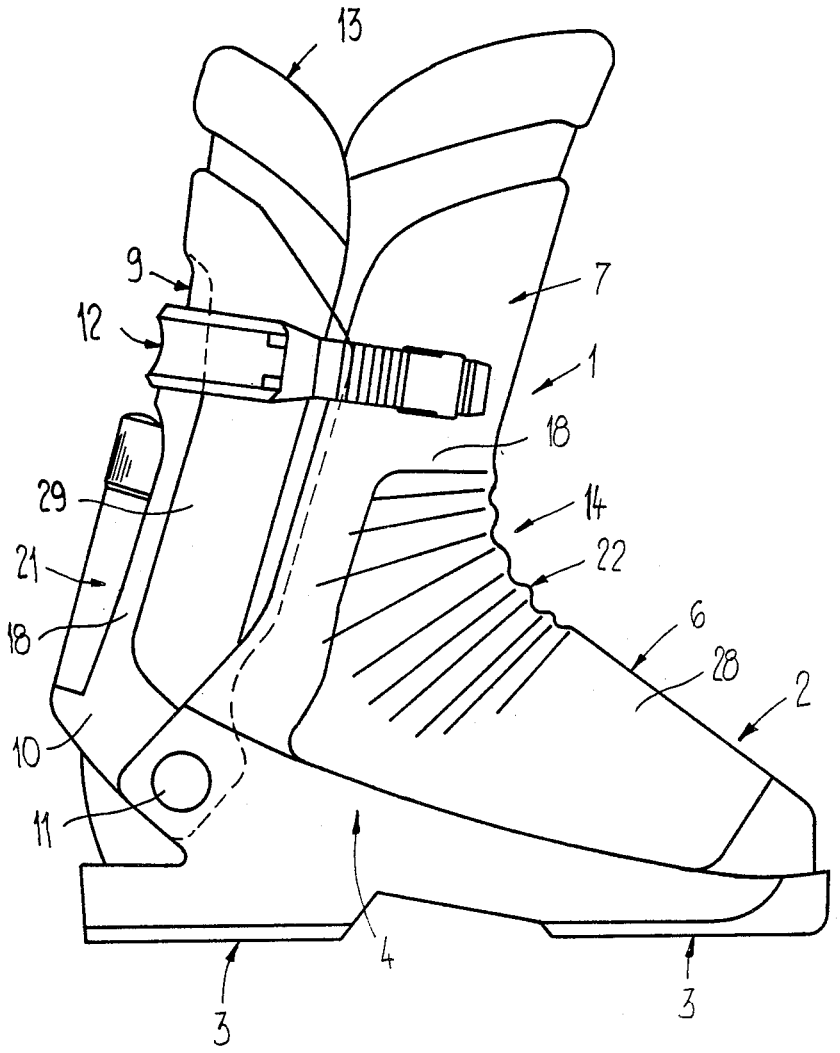
FIG. 11 shows a side view similar to FIG. 7 of a ninth exemplary embodiment of the inventive ski boot.

In the ninth ski boot embodiment shown in FIG. 11, the shell portion 4 is provided with a wall section 28 of greater bending elasticity or flexibility. This wall section 28 extends across or over the instep region 6 into the transition region 14 towards the skin region 7. Furthermore, also the rear shaft or spoiler portion 10 contains a wall section 29 made of a plastic material different from that of the remainder of the rear shaft or spoiler portion 10 and possessing a greater bending or flexural elasticity or flexibility than the remaining part of the rear shaft or spoiler portion 10. As will be evident from FIG. 11, this more bending-elastic or flexible wall section 29 extends on either side of the rear shaft or spoiler portion 10 in an upward direction and around the calf region 9 above the closure assembly 12. In the ski boot shown in FIG. 11, the parts of the shell portion 4 and of the rear shaft or spoiler portion 10 are made of a more bending-rigid plastic material than the wall sections 28 and 29 and form a kind of frame which provides the desired stiffness of the ski boot in the lateral direction but permits bending in lengthwise direction of the ski boot.

Figure 12:
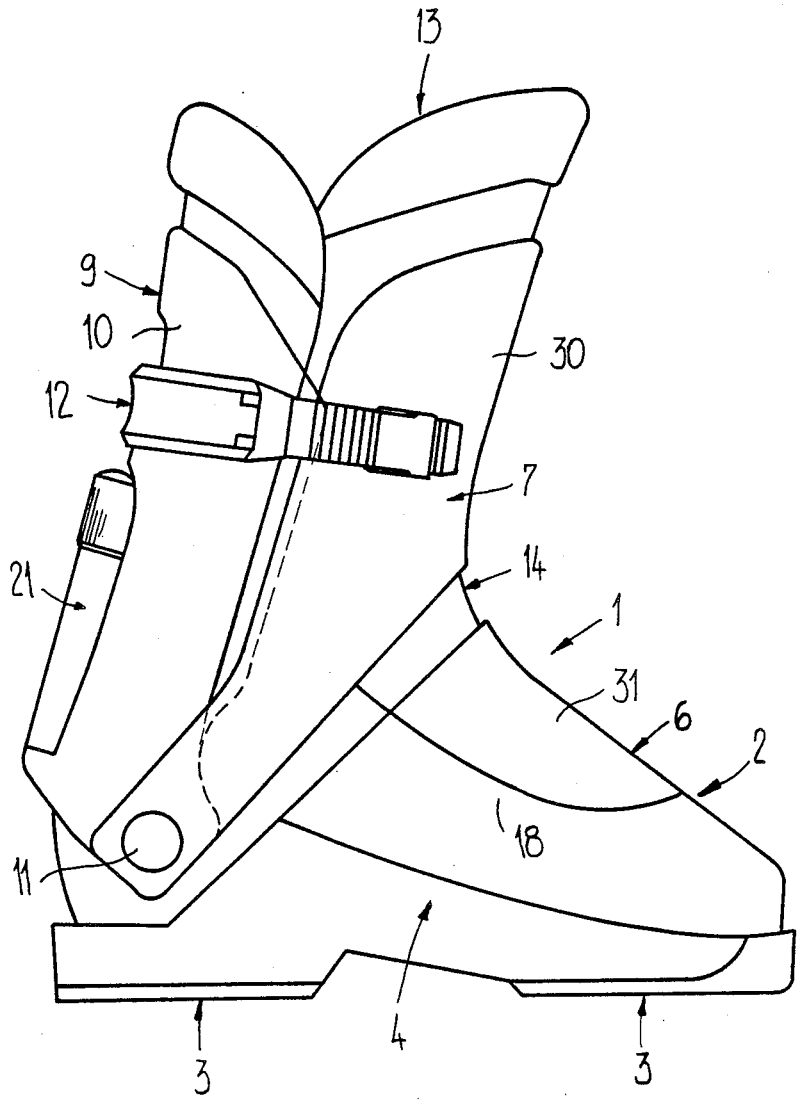
FIG. 12 shows a side view of a tenth exemplary embodiment of the inventive ski boot incorporating a hinged front shaft portion and a more bending-elastic or flexible wall section.
Figure 13:
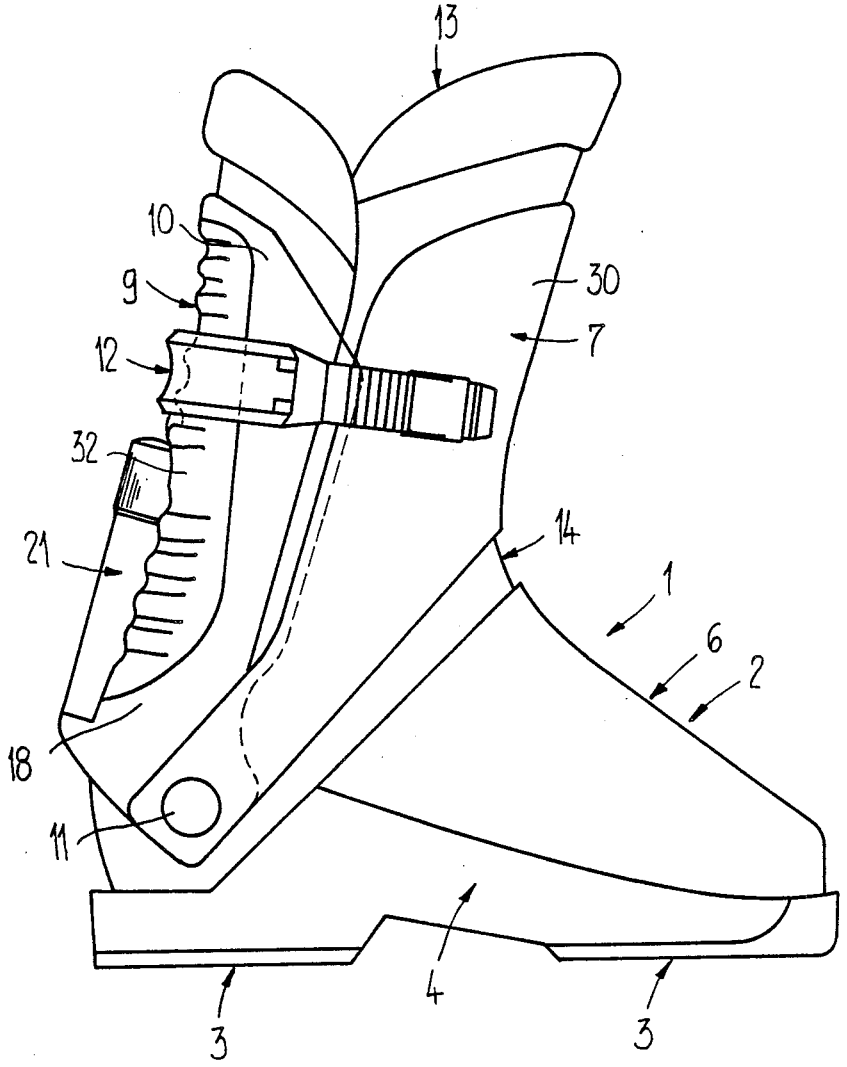
FIG. 13 shows a side view similar to FIG. 12 of an eleventh exemplary embodiment of the inventive ski boot containing a more bending-elastic or flexible wall section in a rear shaft portion.
Figure 14:
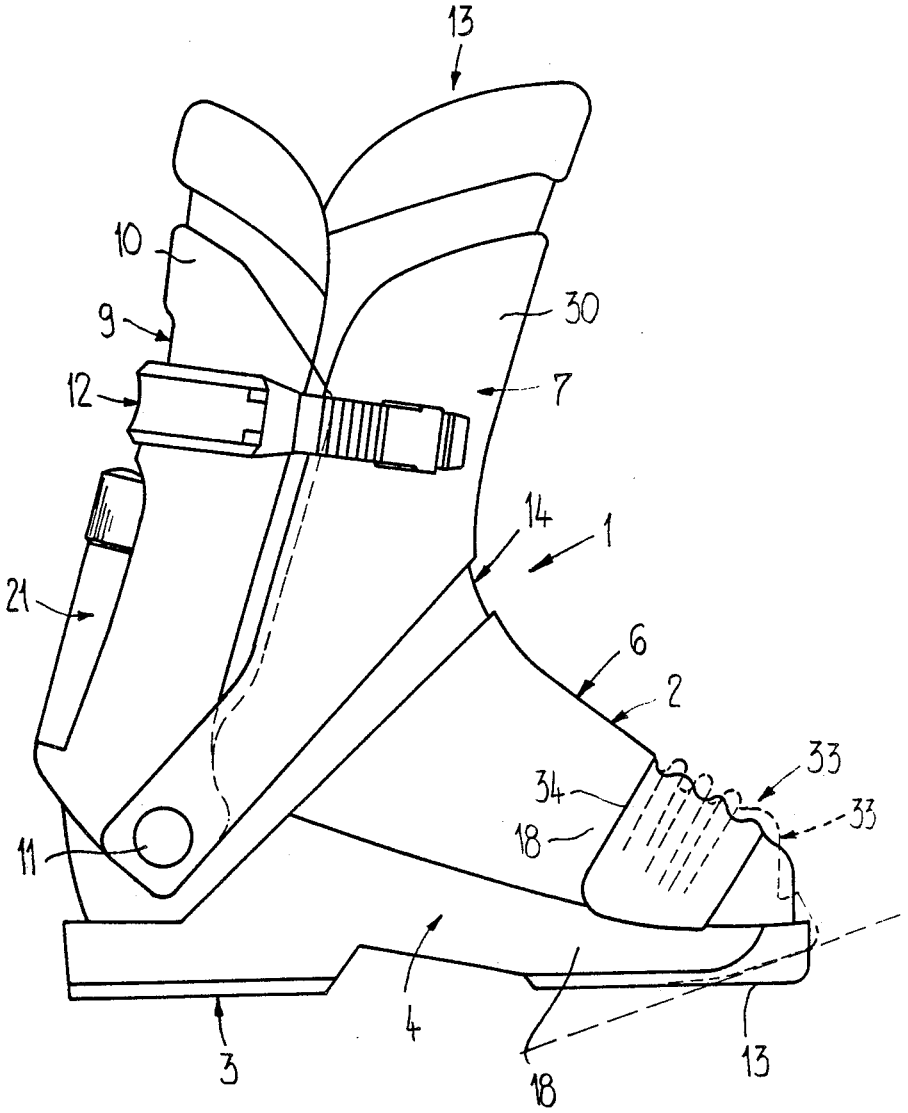
FIG. 14 shows a side view similar to FIG. 12 of a twelfth exemplary embodiment of the inventive ski boot containing a more bending-elastic or flexible wall section in a shoe tip region.

In the tenth to twelfth exemplary embodiments of the inventive ski boot, respectively shown in FIGS. 12, 13 and 14, there is linked to the hinges or pivot joints 11, in addition to the rear shaft or spoiler portion 10, a front shaft portion 30 which extends across the shin region 7. The shell portion 4 in the ski boot embodiment shown in FIG. 12 is provided with a wall section 31 in the instep region 6 and in the transition region 14. This wall section 31 has greater or higher bending elasticity or flexibility than the remainder of the shell portion 4.

In the FIG. 13 embodiment, the rear shaft or spoiler portion 10 is provided with a corrugated or ribbed wall section 32 which has a greater bending elasticity or flexibility than the remainder of the rear shaft or spoiler portion 10.

The twelfth ski boot embodiment illustrated in FIG. 14 is provided with a corrugated or undulated wall section 34 in the region or area of a shoe tip region 33. This wall section 34, which has a greater bending or flexural elasticity or flexibility and extends across the shoe upper portion 2 in the toe region, facilitates walking as indicated by the broken lines of the shoe tip region 33.

Fabrication of the ski boots depicted in FIGS. 4 to 14 basically is effected by injection molding in the manner as explained with reference to the ski boot shown in FIG. 1. Additionally, other fabricating modes are possible, such as transfer molding of relevant parts of the ski boot while in the plastic state. Thus, the more bending-elastic or flexible wall sections 15 to 17, 20, 23 to 29, 31, 32, and 34 can be produced in th same injection mold as the remainder of the shoe upper portion 2 and approximately simultaneously therewith. This can be accomplished by introducing the different materials into the same injection mold. It is also quite feasible to produce the abovementioned more or bending-elastic flexible wall sections separately, as explained with reference to FIG. 1, and thereafter to insert the same into corresponding apertures in the shell portion 4, the tongue portion 5 and the rear shaft or spoiler portion 10 and substantially undetachably join or attach the same to the surrounding wall region 18 by high-frequency or ultrasonic welding or by adhesive bonding.

The material used for the more bending-elastic or flexible wall sections 15, 20, 23 to 29, 31, 32 and 34 preferably has a different bending or flexural elasticity or flexibility or a different density than the material used for the remainder of the shoe upper portion 2. For this purpose, there can be used plastic materials which belong to the same chemical category but have different characteristics or properties, or different plastic materials. Under circumstances, even synthetic rubber can be used for the wall sections having greater bending or flexural elasticity or flexibility.

Only some possible constructions and arrangements of the more bending-elastic or flexible wall sections have been described and illustrated. It is to be understood that such more bending-elastic or flexible wall sections can also be provided at locations other than those illustrated and described hereinbefore. In addition other combinations than those shown and described of different wall sections having greater bending or flexural elasticity or flexibility are possible at the same ski boot. For example, also in the ski boots shown in FIGS. 1 and 4 to 6, the rear shaft or spoiler portion 10 can be provided with a more bending-elastic or flexible wall section.

The sole portion 3 can be made of a material different from that of the shell portion 4 in order to afford desired characteristics of such sole portion 3 like, for example, low wear, good gripping, etc.

Due to the provision of the wall sections 15 to 17, 20, 23 to 29, 31, 32 and 34 having greater bending or flexural elasticity or flexibility, walking and bending of the lower leg in the lengthwise direction of the boot is facilitated without being at the expense of a poor retention of the foot in the ski boot. Since the lesser bending stiffness or rigidity of these wall sections is obtained by using a different type of material, it is possible without too much difficulty to provide such wall sections at the most different suitable locations at the ski boot. In addition, there exists great freedom in selecting the configuration and construction of the wall sections having the greater bending or flexural elasticity or flexibility. By the choice of material for these wall sections and the arrangement thereof it is possible to manufacture ski boots which can be adapted with respect to their bending behavior or characteristics to the requirements of different categories of skiers without incurring a considerable additional manufacturing expenditure.

While there are shown and described present preferred embodiments of the invention, it is to be distinctly understood that the invention is not limited thereto, but may be otherwise variously embodied and practiced within the scope of the following claims.

Accordingly, what we claim is:

1. An article of athletic footwear, especially a ski boot, comprising:

a shoe upper portion;

said shoe upper portion containing at least one wall section subjected to bending load and a wall region surrounding said at least one wall section;

said at least one wall section possessing a lower flexural rigidity than said surrounding wall region;

said at least one wall section being made of a different type of material than said surrounding wall region; and said at least one wall section being substantially undetachably attached to said surrounding wall region.

2. The article of athletic footwear as defined in claim 1, wherein:

said shoe upper portion contains at least one further wall section; and said at least one further wall section possessing a flexural rigidity which differs from the flexural rigidity of said surrounding wall region as well as from the flexural rigidity of said at least one wall section.

3. The article of athletic footwear as defined in claim 1, wherein:

said at least one wall section and said surrounding wall region are made of materials having different flexural rigidities.

4. The article of athletic footwear as defined in claim 1, wherein:

said at least one wall section and said surrounding wall region are made of materials of different densities.

5. The article of athletic footwear as defined in claim 1, wherein:

said at least one wall section and said surrounding wall region are made of different synthetic materials.

6. The article of athletic footwear as defined in claim 5, wherein:

said at least one wall section and said surrounding wall region are made of different synthetic materials; and said different synthetic materials belonging to the same chemical category but possessing different properties.

7. The article of athletic footwear as defined in claim 6, wherein:

said same chemical category is the category of polyamides.

8. The article of athletic footwear as defined in claim 1, wherein:

said shoe upper portion inclusive of said at least one wall section constitutes an injection molded part.

9. The article of athletic footwear as defined in claim 1, wherein:

said shoe upper portion inclusive of said at least one wall section constitutes a transfer molded part.

10. The article of athletic footwear as defined in claim 1, wherein:

said at least one wall section and said surrounding wall region are interconnected by fusing in the plastic state.

11. The article of athletic footwear as defined in claim 1, wherein:

said at least one wall section and said surrounding wall region are interconnected by high-frequency welding.

12. The article of athletic footwear as defined in claim 1, wherein:

said at least one wall section and said surrounding wall region are interconnected by ultrasonic welding.

13. The article of athletic footwear as defined in claim 1, wherein:

said at least one wall section and said surrounding wall section are interconnected by adhesive bonding.

14. The article of athletic footwear as defined in claim 1, wherein:

said at least one wall section has a predetermined wall thickness and a border region;

said surrounding wall region having a predetermined wall thickness; and said predetermined wall thickness of said at least one wall section, at least in said border region of said at least one wall section, substantially corresponding to said predetermined wall thickness of said surrounding wall region.

15. The article of athletic footwear as defined in claim 1, wherein:

said shoe upper portion further comprises an instep region, a shin region and a transition region;

said transition region extending from said instep region to said shin region; and said at least wall section, which possesses said lower flexural rigidity, being provided in said transition region.

16. The article of athletic footwear as defined in claim 1, wherein:

said shoe upper portion further comprises a shin region; and said at least one wall section, which possesses said lower flexural rigidity, being provided in said shin region.

17. The article of athletic footwear as defined in claim 1, wherein:

said shoe upper portion further comprises an instep region; and said at least one wall section, which possesses said lower flexural rigidity, being provided in said instep region.

18. The article of athletic footwear as defined in claim 1, wherein:

said shoe upper portion further comprises a calf region; and said at least one wall section, which possesses said lower flexural rigidity, being provided in said calf region.

19. The article of athletic footwear as defined in claim 1, wherein:

said shoe upper portion further comprises a shoe tip region; and said at least one wall section, which possesses said lower flexural rigidity, being provided in said shoe tip region.

20. The article of athletic footwear as defined in claim 15, wherein:

said at least one wall section has a corrugated profile.

21. The article of athletic footwear as defined in claim 1, wherein:

said shoe upper portion further comprises an instep region, a shin region and a transition region;

said transition region extending from said instep region to said shin region; and said transition region containing a corrugated-profiled section having a corrugated profile.

22. The article of athletic footwear as defined in claim 21, wherein:

said section having the corrugated profile constituting said at least one wall section which possesses said lower flexural rigidity.

23. The article of athletic footwear as defined in claim 21, wherein:

said section having the corrugated profile contains elevations and depressions; and said elevations and said depressions selectively constituting said at least one wall section which possesses said lower flexural rigidity.

24. The article of athletic footwear as defined in claim 1, wherein:

said article is made of at least one synthetic material.

* * * * *